United States Patent [19]

Price, Jr.

[11] Patent Number: 4,484,827

[45] Date of Patent: Nov. 27, 1984

[54] INK CARTRIDGE

[75] Inventor: Lewis C. Price, Jr., Yonkers, N.Y.

[73] Assignee: Dennison Manufacturing Company, Framingham, Mass.

[21] Appl. No.: 464,279

[22] Filed: Feb. 7, 1983

[51] Int. Cl.[3] ..... B43K 5/04

[52] U.S. Cl. ..... 401/205; 101/103; 101/333; 101/335; 118/268; 400/202.2; 401/152; 401/157; 401/207

[58] Field of Search ..... 101/101, 103, 104, 335, 101/333, 125; 401/205, 206, 207, 196, 198, 199, 281, 291, 263, 265, 270; 118/268, 264; 400/197, 202.2, 202.3, 202.4, 470, 471, 471.1; 222/564, 565, 496

[56] References Cited

U.S. PATENT DOCUMENTS

| | | | |
|---|---|---|---|
| 1,366,802 | 1/1921 | Hedge | 400/197 |
| 2,414,895 | 1/1947 | Reynolds et al. | 101/103 |
| 3,641,934 | 2/1972 | Rudolf | 118/264 X |
| 3,682,848 | 8/1972 | Virnelson | 118/264 X |
| 3,987,137 | 10/1976 | Neumann et al. | 101/103 X |
| 4,035,090 | 7/1977 | Bavaveas | 401/198 X |

FOREIGN PATENT DOCUMENTS

| | | | |
|---|---|---|---|
| 2208595 | 7/1979 | Fed. Rep. of Germany | 101/103 |
| 708344 | 7/1931 | France | 222/565 |
| 473782 | 8/1952 | Italy | 401/263 |

*Primary Examiner*—Edgar S. Burr
*Assistant Examiner*—Moshe I. Cohen
*Attorney, Agent, or Firm*—Barry D. Josephs; George E. Kersey

[57] ABSTRACT

A disposable ink cartridge for use in automatic marking systems. The ink cartridge is composed of a housing which contains a collapsible elastomeric ink reservoir having an open end secured to a plurality of barrier disks. The barrier disks are apertured to permit passage of ink through and between them, from the reservoir. An ink absorbing member of fibrous or porous material is positioned at the other, outlet end of the cartridge housing. The ink cartridge provides a constant flow of ink when the ink absorbing member is contacted by a print head or the like until the supply of ink is depleted from the reservoir. The cartridge design permits depletion of essentially the entire reservoir under the above conditions.

7 Claims, 5 Drawing Figures

INK CARTRIDGE

BACKGROUND OF THE INVENTION

1. Field of the Invention

The present invention relates to an ink cartridge for use in automatic marking systems for imprinting the surfaces of either stationary or moving articles or a moving web.

2. Description of the Prior Art

Prior art ink storing cartridges for use in automatic marking systems conventionally employ a reservoir container filled with an ink absorbing wick or absorbent filler material for transmitting ink from the interior of the reservoir container to an open outlet end thereof. One end of the wick or filler material is positioned at the open outlet end of the reservoir container so that as a transfer roller or print head contacts this end of the wick or filler, ink may be transferred therefrom to the roller or print head at the point of contact. If a transfer roller is used, ink transferred from the wick to the roller is then, in turn, transferred automatically to a print head. The print head contains a type face which is wetted with ink to imprint surfaces of articles or substrates that are passed by it. There are a number of disadvantages associated with use of the conventional ink cartridge which employs an ink absorbing wick or filler as the principal means of transmitting ink to its outlet.

One serious disadvantage of conventional cartridges is that since one end of the cartridge is exposed to the environment there is loss of significant amounts of ink through overfeeding and through evaporation. Therefore efforts have been made to cover the exposed end of the ink reservoir from the environment as much as possible. Since fast drying inks containing volatile solvents can be used in ink cartridges adapted to automatic marking systems, even slightly imperfect seals will result in substantial loss of ink. Typically, as much as 40 percent of the ink supply is lost to the environment either by evaporation or leakage when conventional cartridges are used. Since so large a percentage of ink is lost with the conventional cartridges, they tend to be bulkier in size in order to accommodate a larger supply of ink. Also, the conventional cartridges generally require recharging or replacement of the ink supply long before all the ink in the reservoir has been consumed.

Another problem encountered when ink is transmitted principally through capillary action is that the flow of ink is difficult to regulate as the ink supply diminishes within the container. Varying methods have been tried in an effort to maintain an even flow of ink at all stages of cartridge use. Conventional methods have included devices such as wiper blades which contact the surface of the transfer roller to regulate the ink film thickness and thus maintain the flow of ink at an even rate; but this method while regulating the ink flow tends to cause leakage of ink, thus leading to less efficient utilization of the ink supply. It is important to maintain the ink flow at a constant and optimum rate, to ensure print quality.

U.S. Pat. Nos. 3,797,390, 3,662,682, and 3,457,854 are illustrative of the prior art. In U.S. Pat. No. 3,797,390 an ink cartridge for automatic marking systems is disclosed. The ink storage device is essentially composed of an elongated container forming an ink reservoir with a sponge-like ink absorbing filler placed within the container to transmit ink by capillary action from the reservoir to an outlet end of the container. There is included a baffle spacing element beside the foam sponge-like filler to provide a reservoir portion in the bottom of the elongated container. The ink storage device additionally includes a porous felt disk pad which is of very thin construction compared to the foam filler. The felt disk pad is placed in contact with the exposed end of the foam filler and faces the outlet end of the ink storage device. An apertured closing disk is placed over the porous felt disk pad thus exposing a portion of the porous felt disk pad. This reference exemplifies the prior art, with the problems of ink evaporation, vacuum resistance to flow, nonuniform ink flow, and leakage.

U.S. Pat. No. 3,662,682 is further characteristic of prior art ink cartridges which utilize an absorbent filler material as the principal means of transmitting ink. In this reference, a transfer roller is in continuous contact with the exposed end of the absorbent foam filler. As the transfer roller revolves it is coated with ink from the absorbent filler. The transfer roller, in turn, transfers ink to a print head upon contact of the print head with the surface of the transfer roller. Since an absorbent filler is employed as a principal means of transmitting ink to the open end of the ink cartridge, there is great difficulty in regulating the flow of ink as ink is consumed. Various techniques have been employed in an attempt to solve the problem of diminishing ink flow, but with only limited success. The method disclosed in this reference for regulating ink flow is inclusion of a wiper blade which is made to contact the transfer roller under varying degress of pressure adjustable through a spring-like mounting element in contact with the wiper blade. This device poses the problem that the spring tension must be manually adjusted at varying stages as the ink is consumed. The wiper blade additionally does not completely solve the problem of irregular ink flow through the absorbent filler. Also, since the absorbent filler material is so close to the outlet end of the ink cartridge, there is still a persistent problem of high loss of ink from the absorbent filler due to overfeeding, surface evaporation, and leakage.

In U.S. Pat. No. 3,457,854, an ink cartridge for automatic marking systems is disclosed employing in concept elements similar to those disclosed in U.S. Pat. No. 3,662,682. The ink reservoir container is filled with an ink absorbing filler material which is employed as the principal means of transmitting ink by capillary action from the ink reservoir to an open outlet end thereof. A revolving transfer roller contacts an exposed surface of the filler. As disclosed in U.S. Pat. No. 3,662,682, a wiper roller is used to exert varying degrees of pressure on the transfer roller in order to attempt to regulate the flow of ink to the transfer roller and to maintain the ink flow at a constant level as ink in the reservoir is consumed. The wiper roller is adjusted manually by means of a screw which exerts a spring-like force. The wiper roller mechanism, however, is only partially effective in regulating ink flow as ink is consumed.

Accordingly, it is an object of the present invention to provide a disposable ink cartridge which incorporates a fast drying ink, but yet prevents significant loss of ink by evaporation or leakage.

It is an important object of the present invention to provide a disposable ink cartridge for automatic marking systems, which cartridge transmits a constant flow of ink to a print head or transfer roller in contact with the cartridge only as it is being used.

It is another object of the invention to provide an ink cartridge which feeds a constant supply of ink to a transfer roller or print head in contact therewith until the supply of ink in the cartridge is depleted.

SUMMARY OF THE INVENTION

The ink cartridge of the invention is composed of a housing which contains a collapsible ink reservoir, an ink absorbing member, and a barrier structure positioned between an open end of the collapsible ink reservoir and the ink absorbing member. A portion of the ink absorbing member is exposed to the environment through a window at one end of the cartridge housing.

The collapsible ink reservoir is prefilled with fast drying ink for conventional use in automatic marking systems. The open end of the reservoir is secured to the barrier structure, which is preferably composed of a plurality of hard, flat disks having a multiplicity of small apertures. The disks are placed in concentric frictional contact in a manner that the respective apertures of each of the disks is in nonalignment with apertures of any adjacent disk. The ink absorbing member is positioned against an exposed face of the top-most disk.

The ink absorbing member preferably has a volume which is small in comparison to that of the collapsible reservoir. Typically, the volume of the ink absorbing member is less than about 10 percent of the volume of the collapsible reservoir. The ink absorbing member may be composed of a single homogeneous fibrous ink absorbing material, which also has good transudating properties to permit transmission of ink by capillary action. The ink absorbing member functions principally to distribute and disperse the ink rather than for ink storage.

In the preferred embodiment, the ink absorbing member is a two component structure including a transfer pad and a contact pad. The transfer pad is positioned against the barrier structure, and advantageously is formed of a fibrous nonwoven felt material. The contact pad is exposed in part to the external environment, and preferably is formed of porous plastic having an open cell structure. The contact pad is placed in contact with an exposed surface of the transfer pad.

The disks comprising the barrier structure are preferably positioned against each other in nonadhesive, frictional contact. The ink absorbing member and disks are securely bound under moderate pressure, by a cap fastened onto the housing for the collapsible ink reservoir. The cap has a surface aperture so that after it is fastened to the housing a major portion of the ink absorbing member is exposed to the environment. The aperture may be sealed when the cartridge is not in use, and the seal removed to expose the ink absorbing member prior to use.

In use of the cartridge, a print head or transfer roller contacts the exposed surface of the ink absorbing member under slight contact pressure. This forces a small amount of the ink through the apertures of the barrier disks, into the ink absorbing member. An ink absorbing member transmits ink by capillary action to the contact end of the cartridge. As ink is forced from the reservoir by atmospheric pressure, it collapses thereby filling the partial vacuum caused by outflow of ink. The barrier disks, having nonaligned apertures, retard the flow of ink from the reservoir to the ink absorbing member. The flow of ink between disks can be adjusted to a desired level by providing the barrier member with a greater or lesser number of disks.

Surprisingly, the ink cartridge of the invention provides a constant flow of ink from the reservoir through to the ink absorbing member when pressure is exerted on the latter structure. Thus, as a print head or transfer roller contacts the ink absorbing member it is supplied with a constant supply of ink throughout the life of the cartridge until virtually all ink has been depleted from the reservoir. This avoids the need for manual adjustments to the cartridge to increase the ink flow as the ink supply diminishes, while maintaining reliable print quality.

The presence of the barrier members assure dramatically reduced ink loss through leakage or evaporation as compared with conventional ink cartridges. The invention permits useful consumption of as high as about 90 to 95 percent of the total quantity of ink initially supplied to the reservoir.

DETAILED DESCRIPTION

Figure 1:
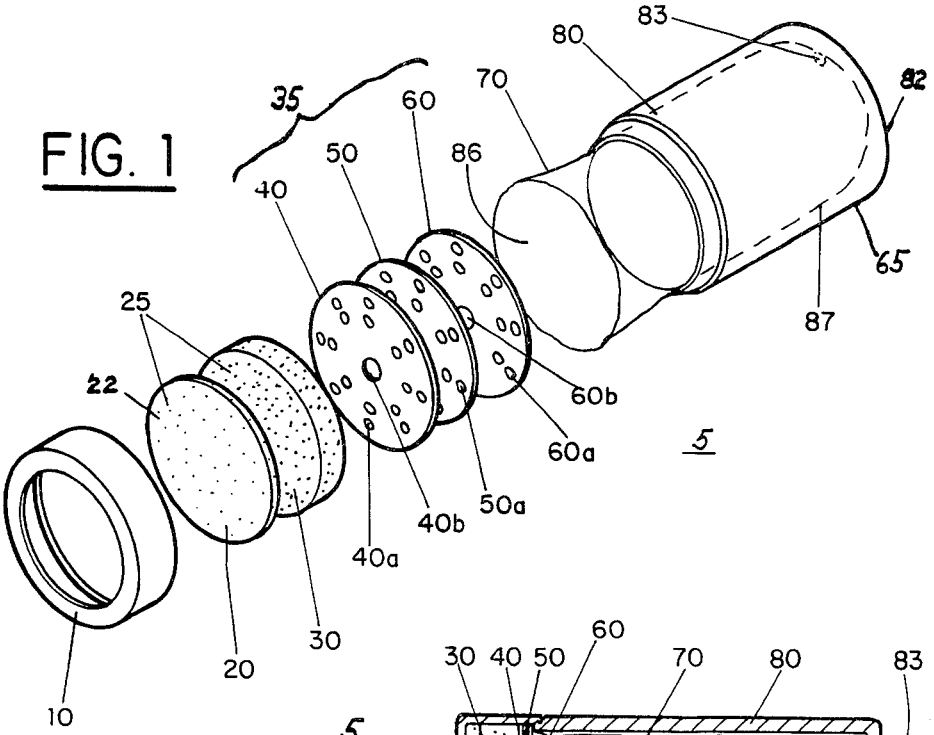
FIG. 1 is an exploded perspective view of the ink cartridge of a preferred embodiment of the invention.
Figure 2:
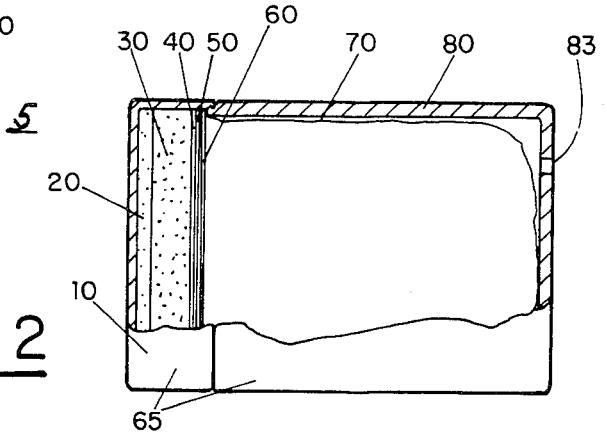
FIG. 2 is a cut-away sectional view of the ink cartridge of FIG. 1.

A preferred embodiment of the disposable ink cartridge of the invention is shown in FIGS. 1 and 2. With reference to the exploded view of FIG. 1, the ink cartridge 5 is composed of a housing 65, a collapsible ink reservoir 70, an ink absorbing member 25, and barrier member 35 of disks 40, 50, and 60 between ink absorbing member 25 and the ink reservoir 70. Housing 65 is composed of a casing 80, collapsible ink reservoir 70, and a cavity cap 10 attached to the open end of casing 80. Casing 80 is open at one end so that collapsible ink reservoir 70 may be inserted therein.

Collapsible ink reservoir 70 may be formed of any collapsible membranous material which is impervious to ink. The reservoir material should be sufficiently durable that it does not burst when filled with a supply of ink and therefore should withstand moderate internal pressures up to at least 10 PSI. The membranous reservoir 70 must also be sufficiently resilient that it readily collapses under atmospheric pressure when a partial internal vacuum is created. Collapsible reservoir 70 must also be chemically resistant to conventional fast drying inks. Collapsible reservoir 70 is advantageously formed of elastomeric material such as latex rubber. Reservoir 70 takes the form of a cylindrical bag closed at one end 87. Preferably, closed end 87 is slightly tapered as shown in FIG. 1. The other end 86 of reservoir 70 is open and protrudes slightly from the open end of casing 80. Reservoir 70 typically has a wall thickness of less than 5 mils, most preferably between 2 and 3 mils, and preferably has the capacity for about 2 fluid ounces of ink. Although reservoir 70 is most suitably formed of latex rubber, alternative materials include, for example, isobutylene, styrene butadiene, and silicone elastomer. In general, any elastomeric material having the above-described properties would be suitable.

The barrier disks are secured to the open end of the collapsible ink reservoir 70. Preferably, the barrier member 35 is composed of at least a pair of barrier disks such as disks 50 and 60, each typically of about 0.1–0.2 mils in thickness, and preferably with a multiplicity of small holes 50*a* and 60*a*. The disks 50 and 60 are placed in concentric frictional contact wherein their respective holes 50*a* and 60*a* are in nonalignment. Most preferably, the barrier member 35 includes an additional disk 40 which also is provided with a plurality of small holes which are in nonalignment with the holes of adjacent disk 50. As best seen in the plan view of FIGS. 3A–3B, disks 40 and 60 may additionally include central apertures 40*b*, 60*b* which are somewhat larger than apertures 40*a*, 60*a*. The various barrier disks may be composed of any of a variety of metals or rigid plastics. These disks are advantageously placed in frictional contact with one another.

An ink absorbing member 25 is placed in contact with an exposed surface of barrier member 35. As illustrated in FIG. 1, ink absorbing member 25 is positioned in contact with the exposed surface of barrier disk 40. Ink absorbing member 25 preferably comprises a cylindrical plug of a thickness typically between about $\frac{1}{4}$ to $\frac{3}{8}$ inches. Thus, the total volume of ink absorbing member 25 is less than about 10 percent of the total volume of reservoir 70. Ink absorbing member 25 may be composed of a homogeneous material which has both ink absorbing and transudating properties, whereby ink may be readily absorbed and transmitted by capillary action. Ink absorbing member 25 is suitably composed of a nonwoven fibrous material, such as compacted wool felt. Alternatively, ink absorbing member 25 may be composed of porous plastic having an open cell structure.

Although member 25 may be composed of one homogeneous structure, most advantageously this member is composed of at least two ink absorbent members of different composition, such as transfer pad 30 and contact pad 20 (FIG. 1). In this embodiment, the transfer pad 30 is positioned closest to friction barrier member 35, and is preferably composed of an absorbent nonwoven fibrous material such as compacted nonwoven wool felt. Transfer pad 30 typically has a thickness of between about $\frac{1}{4}$ to $\frac{3}{8}$ inches so that its total volume is typically less than about 10 percent of the total volume of collapsible reservoir 70.

The contact pad 20 is preferably formed of a porous plastic material of open cell structure, such as porous polyethylene foam having an open cell structure. A contact pad 20 of polyethylene foam material determined to be ideally suited for application to the present invention is available under the tradename GLASROCK from Porex Technologies of Fairburn, Ga. Since the contact pad 20 is more wear-resistant than transfer pad 30 it protects pad 30 from excessive wear which would result if the contact pad 20 were not present. Also, contact pad 20 formed of porous plastic tends to distribute ink better than the transfer pad 30 thus making it more suitable for contact with a print head or transfer roller. Although polyethylene foam is preferred for pad 20, it should be appreciated that other porous plastics may be used having requisite open cell structure and the desired pore size.

The optimum pore size for a given ink viscosity may be determined in advance so that flow through the contact pad can be regulated to the desired level. If conventional fast drying inks are used in the ink cartridge of the present invention, it has been determined that a typical value of pore diameters for contact pad 20 is 10 microns. Although contact pad 20 may be adhesively secured to transfer pad 30, it is preferred that these two pads be held together by pressure exerted by cavity cap 10. Any conventional fast drying ink commonly available for use in automatic marking system cartridges may be used in the ink cartridge of the present invention.

Figure 3A:
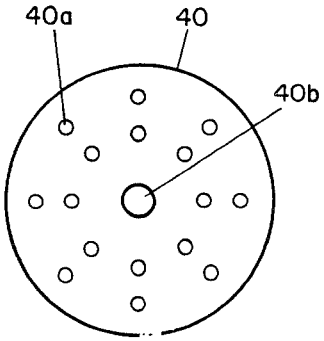
FIGS. 3A–3B and 3C are plan views of barrier disks of the ink cartridge of FIG. 1.
Figure 3B:
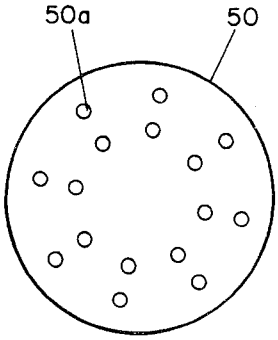
Figure 3C:
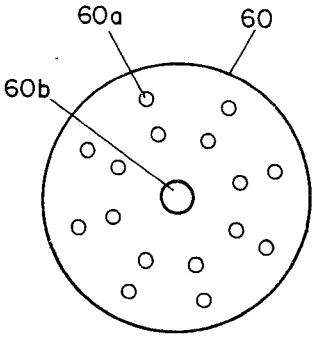

A printing head or transfer roller conventionally employed in such automatic marking systems, as illustrated, for example, in U.S. Pat. Nos. 3,797,390 and 3,662,682 directly contacts the exposed surface 22 of contact pad 20. As a print head or conventional transfer roller contact the exposed surface 22 of contact pad 20, a slight increase in pressure of up to about 2 PSI is exerted correspondingly increasing the internal pressure of the ink stored within reservoir 70. As the pressure of the ink in reservoir 70 is increased, ink is forced through the apertures of the barrier member 35, and then through to transfer pad 30 and contact pad 20. The flow of ink is regulated to the desired level by employing the desired number of disks in barrier member 35 which in effect provide the desired resistance to the flow of ink passing through the reservoir to the ink absorbing member 25. Resistance to flow of the ink is enhanced by the nonalignment of apertures, such as apertures 40*a*, 50*a*, and 60*a* of the respective barrier disks 40, 50, and 60 (FIGS. 3A, 3B, and 3C). Thus, as ink flows through the apertures, a portion of the flow will be diverted transversely between each of the disks. The transverse flow is also enhanced by the slight capillary action created by the spacing between the disks. The disks function to reduce the flow of ink from the reservoir to the ink absorbing member even when higher contact pressures are exerted by the print head or transfer roller against contact pad 20.

As ink is forced from the reservoir through the barrier disks, the reservoir collapses slightly to fill the partial vacuum created therein as ink is depleted. A vent hole 83 is provided in the closed end 82 of casing 80 to assure that the outside surface of ink reservoir 70 is exposed to at least atmospheric pressure, thereby to effect the collapse of the reservoir 70 as ink flows therefrom. In ink absorbing member 25, the flow of ink is achieved principally through capillary action. The ink cartridge of the illustrated embodiment is of compact size, but the invention is not intended to be limited to any particular range in sizes or shape. A suitable size for the ink cartridge 5 is a cartridge length of about 3 inches and an overall width of about $1\frac{1}{2}$ inches. The ink reservoir 70 illustratively has the capacity to hold about 2 ounces of ink. The volume of the ink absorbing member 25 is small, e.g. less than 10 percent that of the collapsible reservoir 70.

The ink cartridge of the present invention has the important advantage that it supplies a constant flow of ink during the entire period of use until all ink has been depleted from reservoir 70. Thus, there is no need to manually regulate the rate of ink flow through the cartridge 5 during its use. As high as about 90 to 95 percent of the ink initially supplied to the print head or transfer roller will be effectively utilized. After the ink supply is depleted, the ink cartridge may simply be discarded and replaced with a new one. Another advantage of the present invention is that since the ink reservoir 70 is not in direct contact with ink absorbing member 25 but rather is separated therefrom by friction barrier member 35, there is a greatly reduced risk of ink evaporation. A further advantage is that the flow of ink is precisely adjustable by inclusion of an appropriate number of friction barrier disks 35 between reservoir 70 and the ink absorping member 25. Also, there is little if any noticeable leakage of ink from the cartridge during any stage of its use.

While the present invention has been described with reference to a preferred embodiment, it should be appreciated that other embodiments, including other component shapes and sizes, are possible without departing from the scope of the invention as set forth in the appended claims. Therefore, the invention is not intended to be limited to the description in the specification, but rather is defined by the language of the claims and equivalents thereof.

I claim:

1. An ink applicator device comprising a collapsible reservoir for storing a supply of ink having an open end;

a container for said reservoir;

an ink-absorbing member located at the outlet end of said applicator device; and barrier means located between the ink-absorbing member and the reservoir for regulating the flow of ink from said reservoir to said ink-absorbing member;

said barrier means comprising a plurality of disks having a plurality of apertures through which ink can flow, said disks coaxially juxtaposed so that the apertures of adjacent disks are in substantial nonalignment and said disks being in nonadhesive contact;

wherein the container has at least one air vent thereby exposing the reservoir exterior surface to ambient pressure;

wherein upon external ink removal from the ink-absorbing member, ink flows from the reservoir through said nonaligned apertures of the disks to the ink-absorbing member creating a partial vacuum in the reservoir partially collapsing the reservoir around the remaining ink therein.

2. An ink applicator as in claim 1 wherein the ink absorbing member is comprised of nonwoven fibrous material.

3. An ink applicator as in claim 1 wherein the ink absorbing member is comprised of a porous plastic having an open cell structure.

4. An ink applicator as in claim 1 wherein the ink absorbing member comprises a member of nonwoven fibrous material in contact with said barrier means and a porous plastic member having an open cell structure at the outlet of said ink applicator device.

5. An ink applicator as in claim 1 wherein the total volume of the ink absorbing member is substantially less than the maximum ink capacity of said reservoir.

6. An ink applicator as in claim 1 wherein the collapsible reservoir is comprised of an elastomeric material.

7. An ink applicator as in claim 6 wherein the reservoir is comprised of latex rubber.

* * * * *